US008690248B2

(12) United States Patent
Huang

(10) Patent No.: US 8,690,248 B2
(45) Date of Patent: Apr. 8, 2014

(54) AUXILIARY MOVING DEVICE

(76) Inventor: Miao-Yuan Huang, Xizhi (TW)

( * ) Notice: Subject to any disclaimer, the term of this patent is extended or adjusted under 35 U.S.C. 154(b) by 327 days.

(21) Appl. No.: 12/791,201

(22) Filed: Jun. 1, 2010

(65) Prior Publication Data

US 2011/0289677 A1 Dec. 1, 2011

(51) Int. Cl.
*A61G 5/00* (2006.01)

(52) U.S. Cl.
USPC ..... 297/344.11

(58) Field of Classification Search
USPC ..... 297/344.11, 344.18, 344.21, 344.22, 297/440.24, 337
See application file for complete search history.

(56) References Cited

U.S. PATENT DOCUMENTS 4,168,549 A * 9/1979 Davies ..... 4/578.1
4,364,606 A * 12/1982 Eknes ..... 297/337
5,599,066 A * 2/1997 Chih ..... 297/383
5,740,563 A * 4/1998 Gaddy ..... 4/579
5,822,809 A * 10/1998 Gallo ..... 4/578.1
5,940,905 A * 8/1999 Cheng ..... 4/578.1
7,335,145 B2 * 2/2008 Webber ..... 482/142
7,661,154 B2 * 2/2010 Cheng ..... 4/560.1
2005/0206114 A1 * 9/2005 Michelau ..... 280/220

* cited by examiner

*Primary Examiner* — David R Dunn
*Assistant Examiner* — Timothy J Brindley
(74) *Attorney, Agent, or Firm* — Alan Kamrath; Kamrath IP Lawfirm, P.A.

(57) ABSTRACT

An auxiliary moving device contains a first cushion and two support members disposed on two sides of the first cushion. The first cushion is allowed to move on the support members, with one of the two support members including a plurality of holes. A positioning mechanism is fixed on the first cushion and includes a post. The post is inserted into one of the holes of the one of the two support members to fix the support member.

4 Claims, 9 Drawing Sheets

AUXILIARY MOVING DEVICE

BACKGROUND OF THE INVENTION

1. Field of the Invention

The present invention relates to an auxiliary moving device and, more particularly, to an auxiliary moving device that includes a positioning mechanism.

2. Description of the Prior Art

A disabled person has to be cared by a caregiver in daily life to get up, move, eat, have rehabilitation treatment or a bath, etc.

To take a bath for example, the caregiver has to assist the disabled person to move toward a bath room and, then, to make the disabled person sit on an auxiliary chair 1 as shown in FIG. 1 to have a bath. However, because a seat is locked on legs of the auxiliary chair 1 during the bath, it is dangerous and difficult to move the disabled person.

The present invention has arisen to mitigate and/or obviate the afore-described disadvantages.

SUMMARY OF THE INVENTION

The primary objective of the present invention is to provide an auxiliary moving device that can help a disabled person move in daily life.

Another objective of the present invention is to provide an auxiliary moving device so that the disabled person can sit on the auxiliary moving device to move comfortably and safely.

To obtain the above objectives, an auxiliary moving device provided by the present invention includes:

a first cushion;

two support members disposed on two sides of the first cushion, with the first cushion moving on the two support members, with one of the two support members including a plurality of holes; and a positioning mechanism fixed on the first cushion and including a post, with the post inserted into one of the holes of the one of the two support members to fix the support member.

DETAILED DESCRIPTION OF THE PREFERRED EMBODIMENTS

The present invention will be clearer from the following description when viewed together with the accompanying drawings, which show, for purpose of illustration only, the preferred embodiments in accordance with the present invention.

Figure 1:
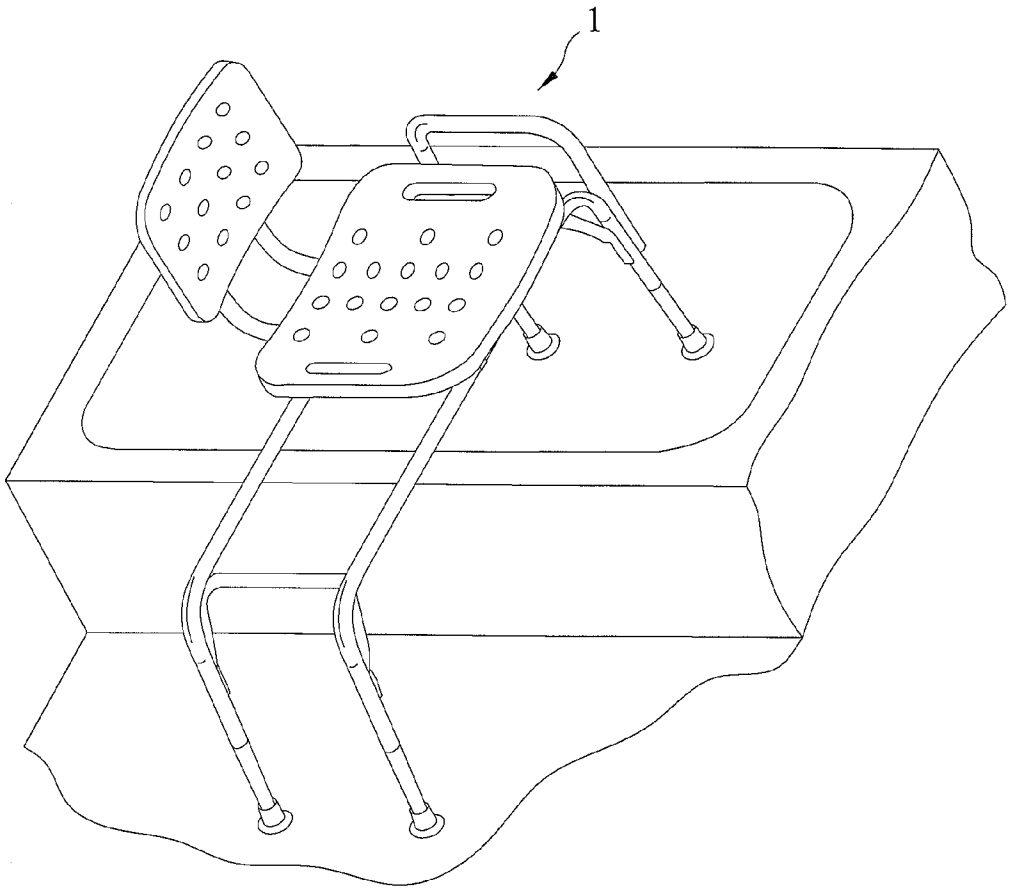
FIG. 1 PRIOR ART
FIG. 1 is a perspective view of a conventional auxiliary moving device.
Figure 2A:
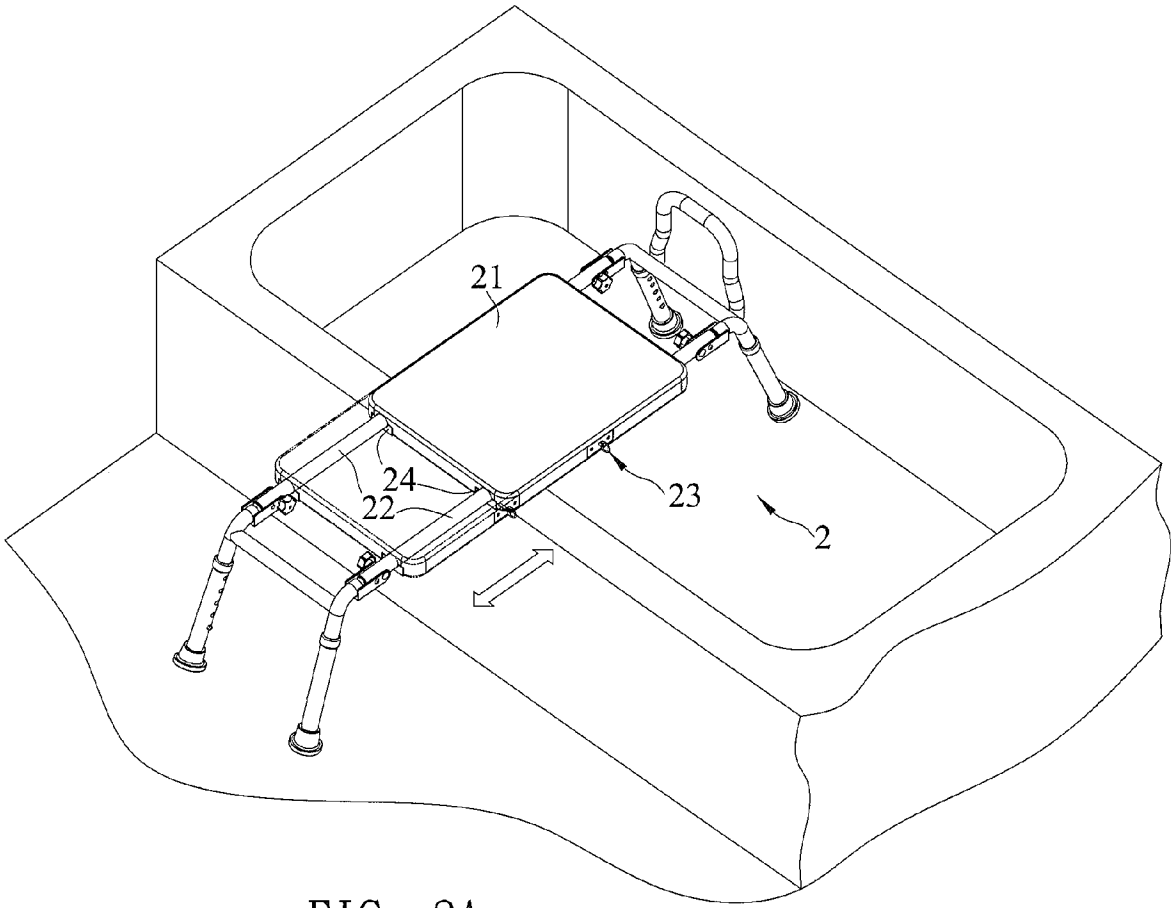
FIG. 2A is a perspective view showing the operation of an auxiliary moving device according to a first embodiment of the present invention.
Figure 2B:
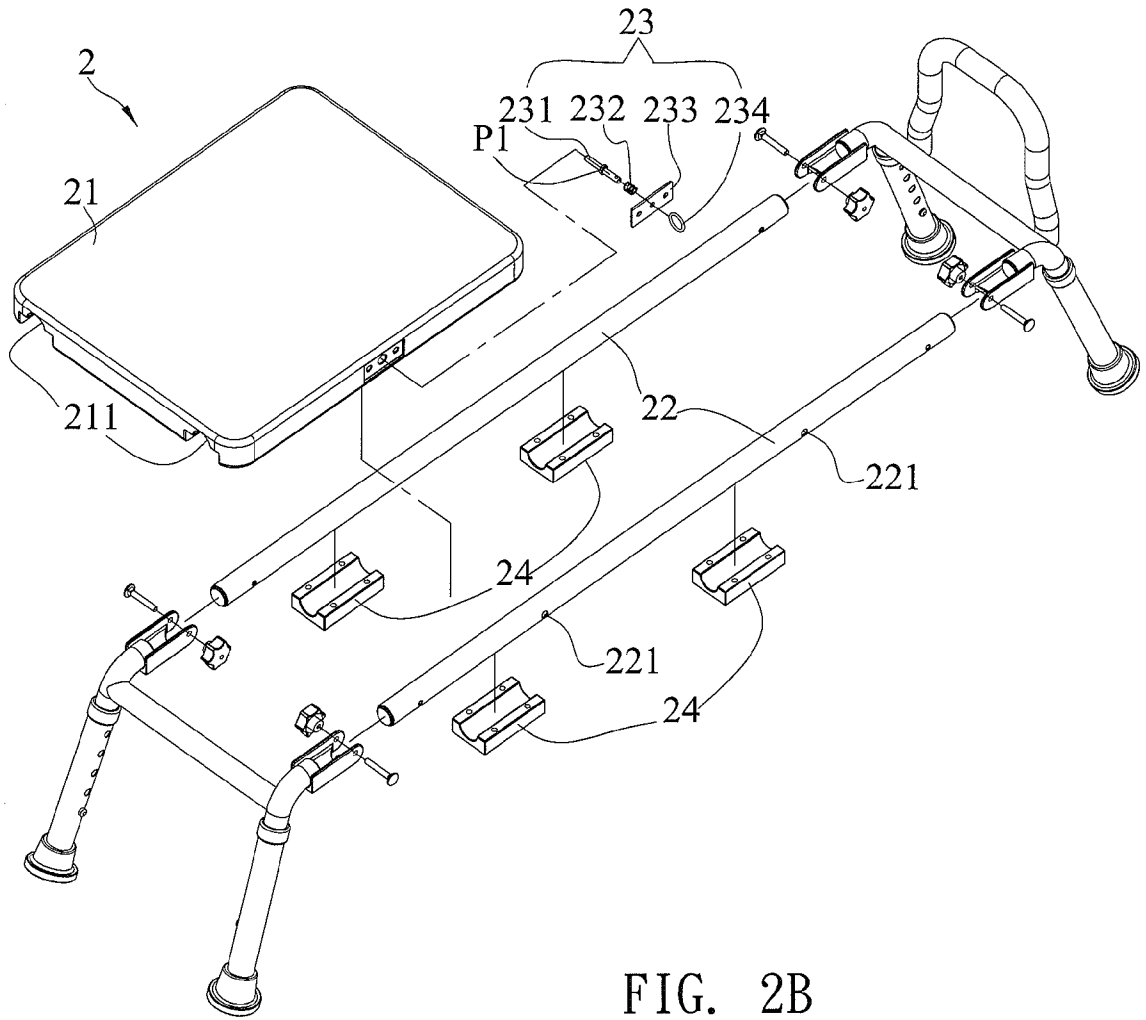
FIG. 2B is a perspective view showing the exploded components of the auxiliary moving device according to the first embodiment of the present invention.

With reference to FIGS. 2A and 2B, an auxiliary moving device 2 in accordance with a first embodiment of the present invention is used to help a disabled person's movement in daily life.

The auxiliary moving device 2 includes a first cushion 21, two support members 22, and a positioning mechanism 23.

The support members 22 are disposed on two sides of the first cushion 21, and the first cushion 21 moves on the support members 22. In this embodiment, the two support members 22 are located at the two sides of the first cushion 21. The first cushion 21 includes two first grooves 211 located at two sides of a bottom end thereof respectively, and each support member 22 matches with the first groove 211.

In other words, to match the support member 22 with the first groove 211 of the first cushion 21, the first groove 211 is formed in a semi-arc shape to cooperate with the support member 22 with a circular cross section so that the first cushion 21 moves on the support member 22.

Figure 2C:
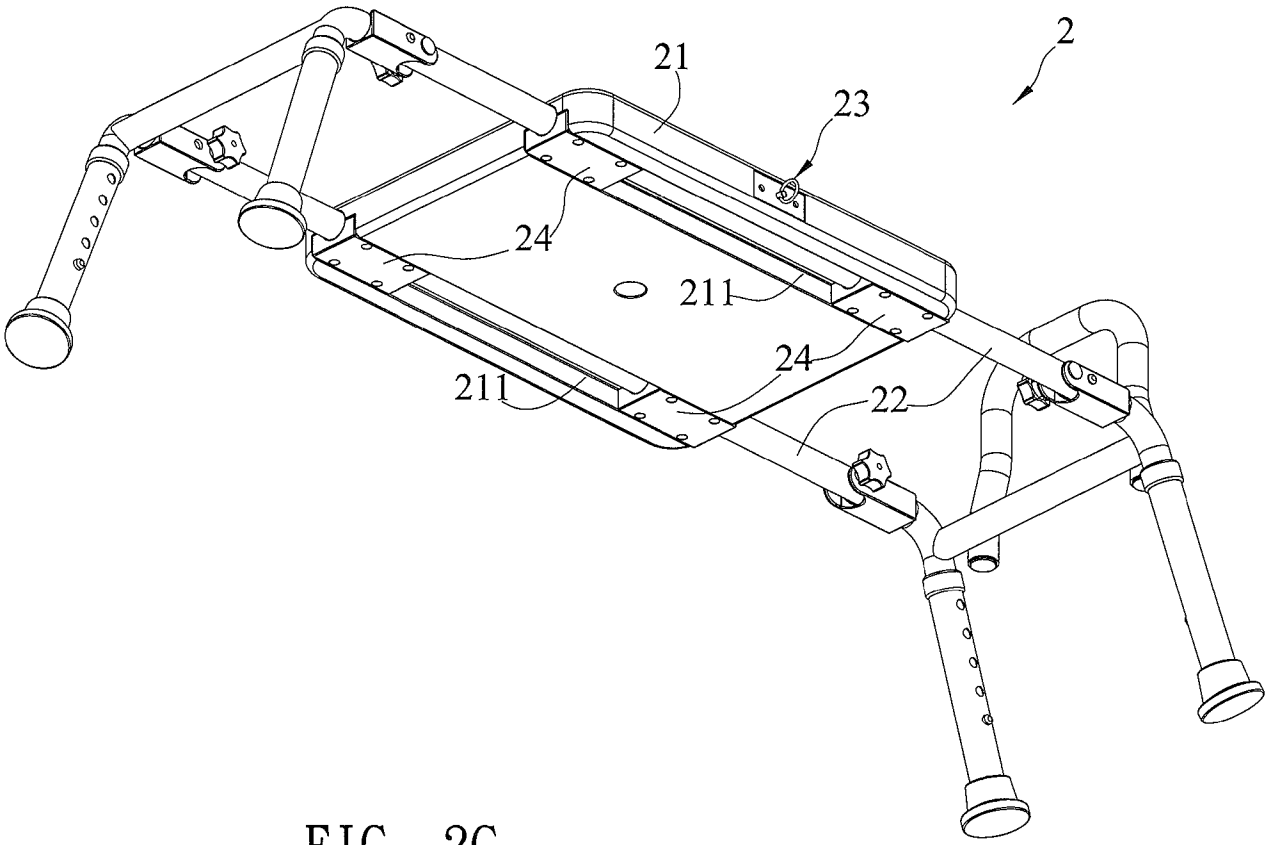
FIG. 2C is a bottom perspective view showing the assembly of the auxiliary moving device according to the first embodiment of the present invention.

As shown in FIGS. 2B and 2C, to make the first cushion 21 move on the support member 22, the auxiliary moving device 2 further includes a plurality of fixing elements 24 connected with the bottom end of the first cushion 21. The support member 22 is retained between the fixing elements 24 and the first cushion 21. In this embodiment, the auxiliary moving device 2 includes four fixing elements 24 to be located at the two sides of the bottom end of the first cushion 21 to connect with the first cushion 21, and the support members 22 are inserted through connections of the first cushion 21 and the fixing elements 24 so that the first cushion 21 moves on the support members 22. Of course, a number and a position of the fixing element 24 are not limited in this embodiment, and they are provided based on different requirements so that the fixing element 24 is connected with the first cushion 21, and the support member 22 moves in the first groove 211 of the first cushion 21.

To match with the support member 22 having the circular cross section, the fixing element 24 is provided with a second groove formed in a semi-arc shape to form a circular cross section with the first groove 211 of the first cushion 21 so that the support member 22 moves in the groove 211 of the first cushion 21.

Figure 3A:
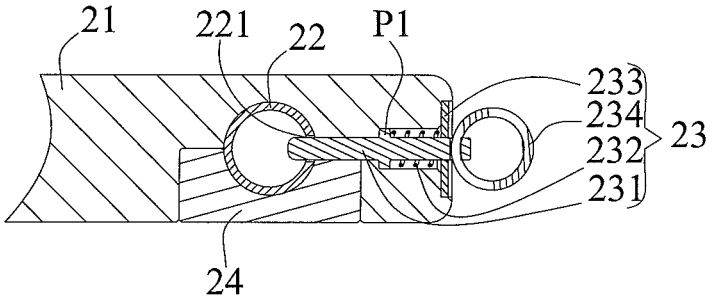
FIG. 3A is a cross sectional view showing a part of a first cushion and a positioning mechanism of the auxiliary moving device according to the first embodiment of the present invention.

Referring to FIGS. 2B and 3A, the positioning mechanism 23 is fixed on the first cushion 21 and includes a post 231, and one of the two support members 22 includes a plurality of holes 221. The post 231, is inserted into one of the holes 221 of the one of the two support members 22 to fix the support member 22. In other words, the positioning mechanism 23 is applied to fix the first cushion 21 on the support member 22.

In this embodiment, the support member 22 shown on a right side of FIG. 2B includes two holes 221. The post 231 cooperates with the hole 221. In other words, a diameter of the hole 221 is larger than that of the post 231 so that the post 231 is inserted into the hole 221 to be positioned.

The positioning mechanism 23 further includes a spring 232, a stopping piece 233, and a pull ring 234. The post 231 is inserted through the spring 232, and the post 231 includes a projection P1 so that the spring 232 is defined between the stopping piece 233 and the projection P1. The pull ring 234 is coupled with the post 231.

Figure 3B:
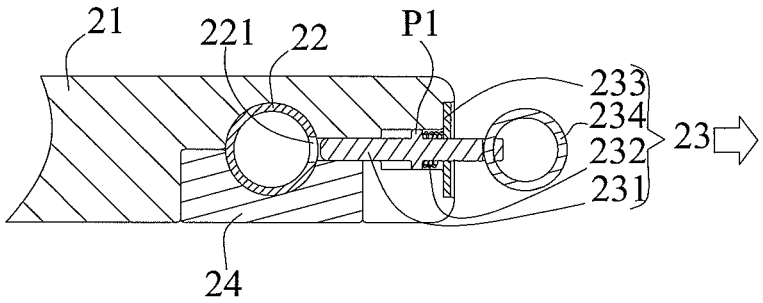
FIG. 3B is a cross sectional view showing a part of the operation of the positioning mechanism of the auxiliary moving device according to the first embodiment of the present invention.

As shown in FIGS. 3A and 3B, the positioning mechanism 23 is operated as follows.

As illustrated in FIG. 3B, when a caregiver pulls the pull ring 234 outward, the projection P1 of the post 231 moves close to the stopping piece 233 to press the spring 232 so that the spring 232 deforms, and the post 231 connected with the pull ring 234 moves away from the hole 221 of the support member 22. In the meantime, the caregiver forces the first cushion 21 so that the first cushion 21 moves relative to the support member 22.

With reference to FIG. 3A, when the post 231 is desired to be placed into another hole 221 of the support member 22 and if the caregiver does not force the post 231, the post 231 is pushed by the spring 232 to insert into the other hole 221 so that the first cushion 21 is fixed to the support member 22 by using the post 231 of the positioning mechanism 23 and the hole 221 of the support member 22. Hence, the first cushion 21 is fixed on the support member 22 without moving by ways of the post 231 of the positioning mechanism 23.

Figure 4A:
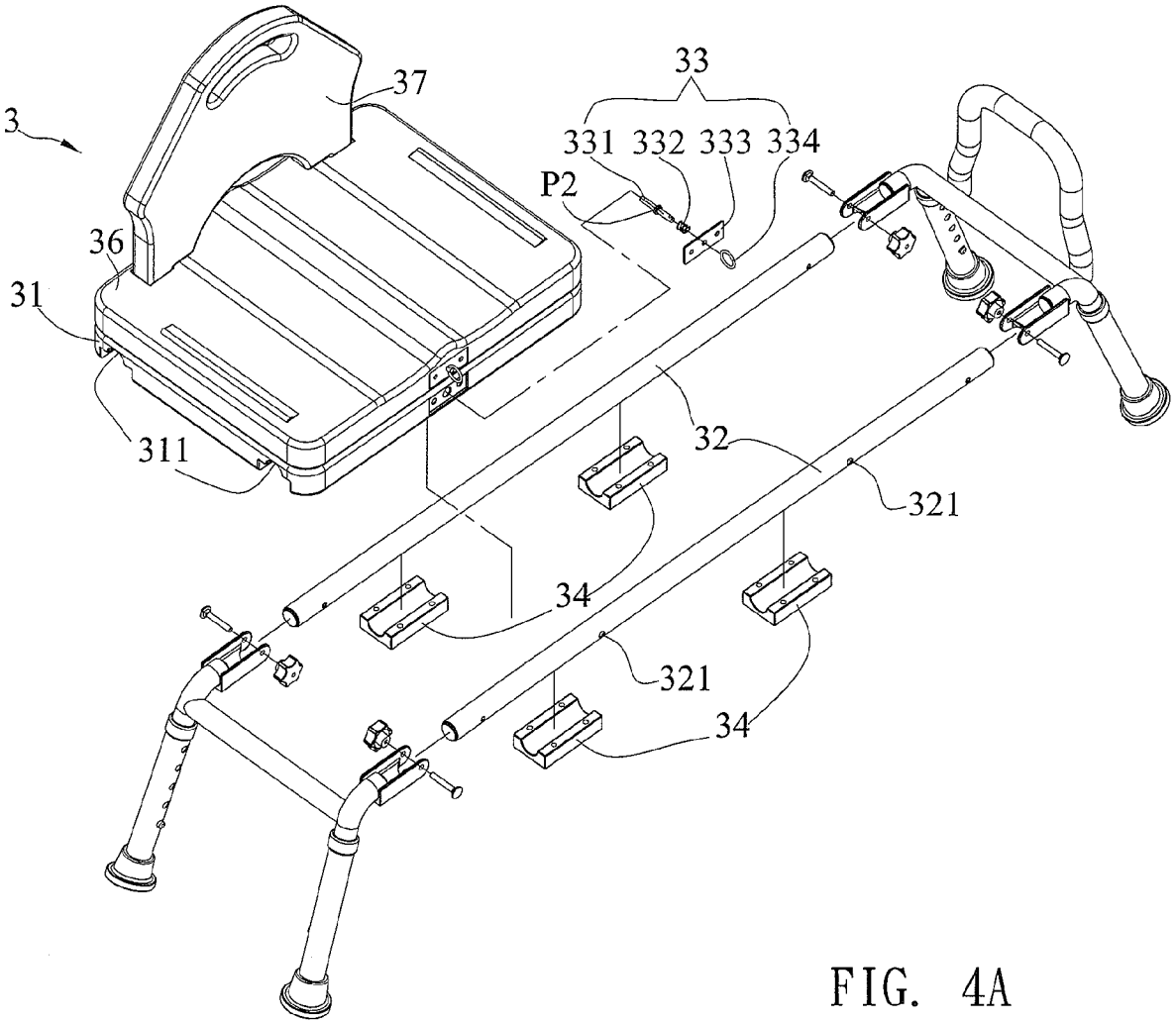
FIG. 4A is a perspective view showing the exploded components of an auxiliary moving device according to a second embodiment of the present invention.
Figure 4B:
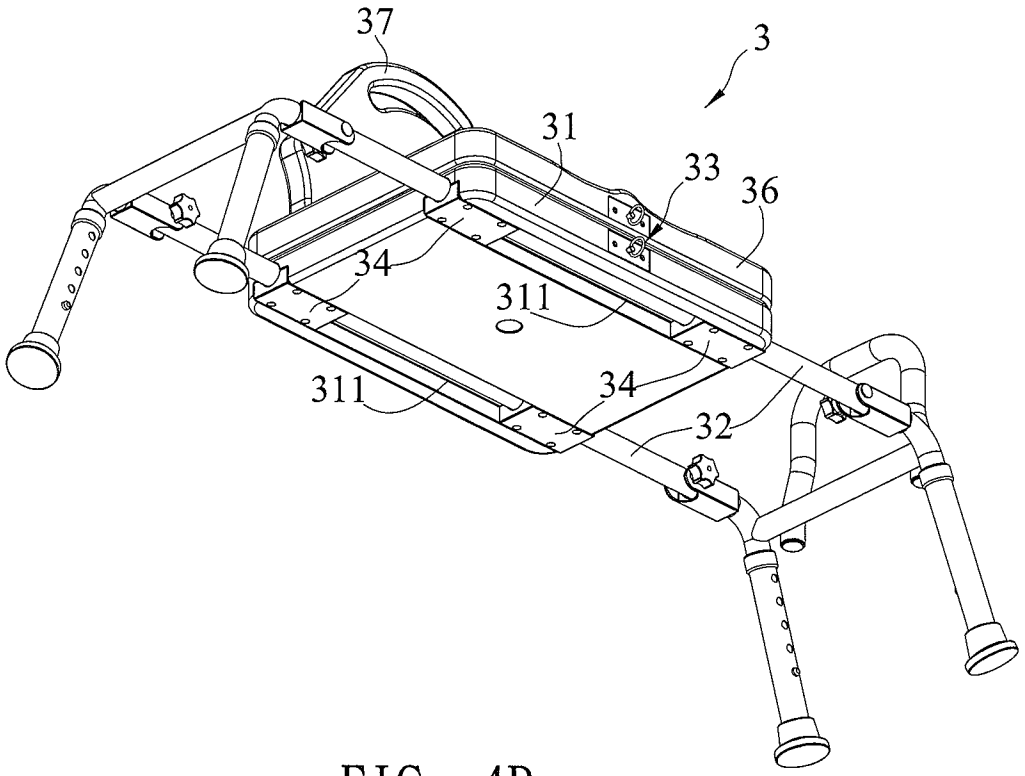
FIG. 4B is a bottom perspective view showing the exploded components of the auxiliary moving device according to the second embodiment of the present invention.

As shown in FIGS. 4A and 4B, a difference of an auxiliary moving device 3 according to a second embodiment of the present invention from the auxiliary moving device 2 of the first embodiment includes a second cushion 36 and a chair back 37. The second cushion 36 is disposed on a first cushion 31 and connected with the first cushion 31, and the chair back 37 is fixed on one side of the second cushion 36 so that the disable person sits on the auxiliary moving device 3 to move comfortably and safely.

Because the other related components of the auxiliary moving device 3 are identical to those of the auxiliary moving device 2, further remarks are omitted.

Figure 5A:
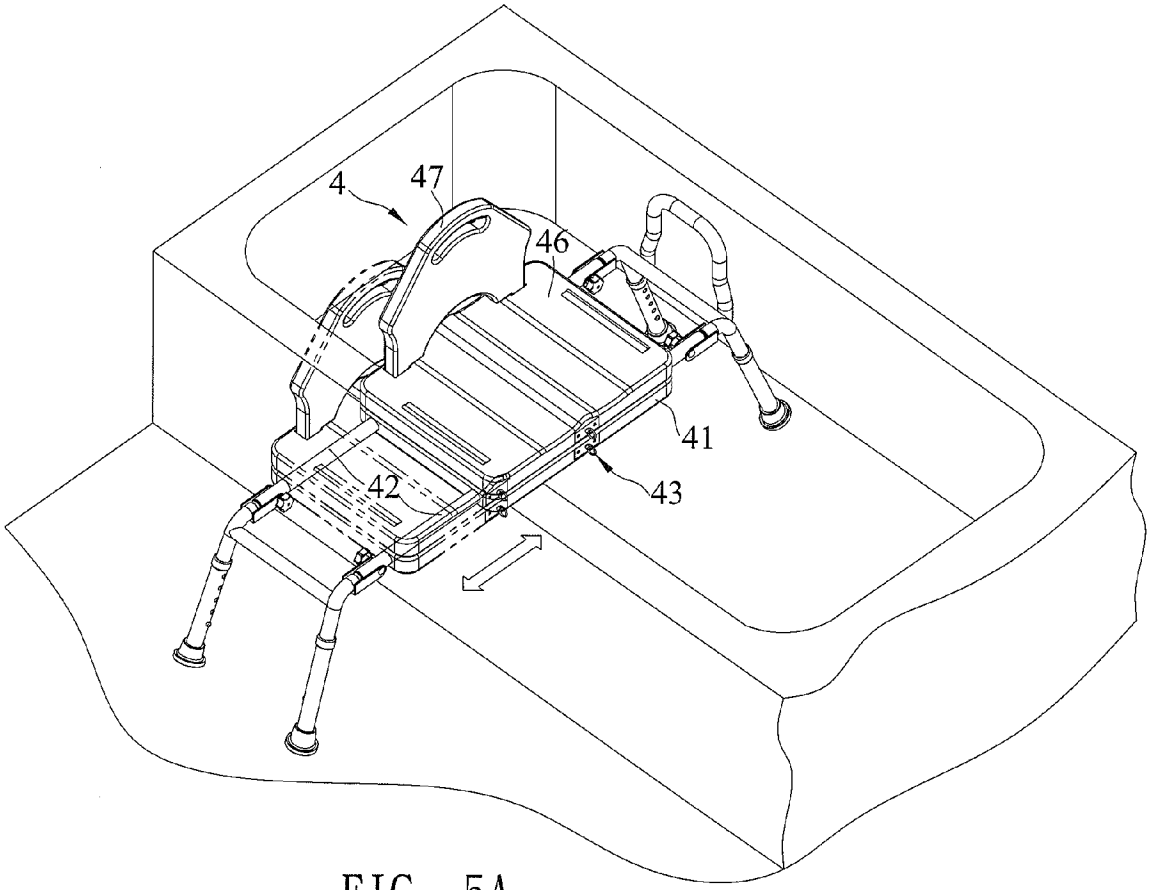
FIG. 5A is a perspective view showing the operation of an auxiliary moving device according to a third embodiment of the present invention.
Figure 5B:
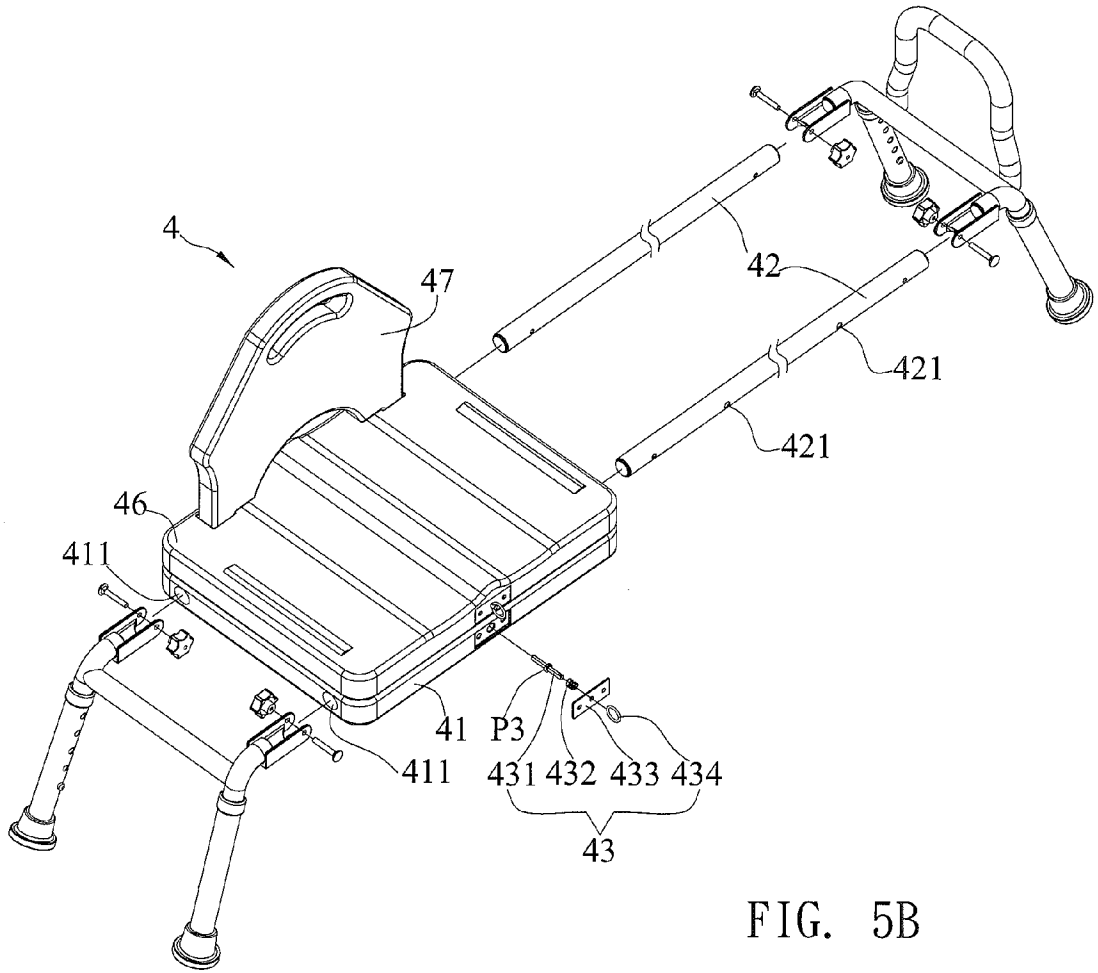
FIG. 5B is a perspective view showing the exploded components of the auxiliary moving device according to the third embodiment of the present invention.

As illustrated in FIGS. 5A and 5B, a difference of an auxiliary moving device 4 according to a third embodiment of the present invention from the auxiliary moving device 3 of the second embodiment includes a first cushion 41 having two orifices 411 which are located at two sides of a bottom end of the first cushion 41, and two support members 42 are fixed on the first cushion 41 by using the orifices 411. In other words, an inner diameter of the orifice 411 is larger than a diameter of a cross section of the support member 42 so that the support member 42 is inserted into the first cushion 41 through the orifice 411, and the first cushion 41 moves on the support member 42 securely.

Because the other related components of the auxiliary moving device 4 are identical to those of the auxiliary moving device 3, further remarks are omitted.

Thereby, the first cushion of the auxiliary moving device is allowed to move on the support members, and one of the support members includes a number of positioning holes, The positioning mechanism includes the post. The post is inserted into one of the holes by using the positioning mechanism to be fixed on the support member. Hence, the disabled person sitting on the first cushion is capable of moving on the support member easily. In addition, the post of the positioning mechanism is inserted into the hole of the support member so that the first cushion is fixed on the support member without moving. Therefore, the auxiliary moving device can help the disabled person to move in daily life easily and safely.

While various embodiments in accordance with the present invention have been shown and described, it is clear to those skilled in the art that further embodiments may be made without departing from the scope of the present invention.

What is claimed:

1. An auxiliary moving device comprising:

a first cushion having a bottom end extending between first and second ends and between first and second edges, with the first and second edges extending between the first and second ends, wherein the first cushion includes two first grooves located at two sides and extending into the bottom end thereof respectively, with the two first grooves extending between the first and second ends intermediate and spaced from the first and second edges, wherein each of the two first grooves includes a channel spaced from the first and second edges and having a depth from the bottom end and an upper track extending from the channel to a depth from the bottom end greater than the depth of the channel, with the channel located intermediate the upper track and the bottom end;

two support members disposed on two sides of the first cushion, with the first cushion allowed to move on the two support members, wherein one of the two support members includes a plurality of holes;

a positioning mechanism fixed on the first cushion and including a post, a spring and a stopping piece, with the stopping piece separately formed from the first cushion and secured to the first cushion, wherein the post is inserted through the spring and the stopping piece, wherein the spring is defined between the stopping piece and a projection of the post, with the post being inserted into one of the plurality of holes of the one of the two support members to fix the one of the two support members, with the spring located intermediate the one of the two support members and the stopping piece, with the one of the two support members located intermediate the post and another of the two support members; and a plurality of fixing elements separately formed from the first cushion and each including a lower track of a size for slideably receiving one of the two support members, with the plurality of fixing elements connected with the bottom end of the first cushion, wherein the two support members are retained in the two first grooves between the lower tracks of the plurality of fixing elements and the upper tracks of the first cushion, with the upper and lower tracks being of size and shape corresponding to and for slideably abutting and receiving the two support members, with each fixing element having a size and shape corresponding to and for receipt in the channel, with the plurality of fixing elements being flush with the bottom end when connected with the bottom end and being spaced from and intermediate the first and second edges.

2. The auxiliary moving device as claimed in claim 1, wherein when the post is moved away from the hole of the support member, the first cushion moves relative to the support member.

3. The auxiliary moving device as claimed in claim 1, wherein when the first cushion moves on the two support members, the projection of the post and the stopping piece press and deform the spring.

4. The auxiliary moving device as claimed in claim 1 further comprising a second cushion disposed on the first cushion and a chair back fixed on one side of the second cushion.

* * * * *